United States Patent [19]

Harward et al.

[11] 4,305,238

[45] Dec. 15, 1981

[54] INSULATING SIMULATED LOG AND SIDING

[76] Inventors: Leland A. Harward; Phyllis L. Harward, both of Box 404, Mountain Home, Id. 83647

[21] Appl. No.: 66,127

[22] Filed: Aug. 13, 1979

Related U.S. Application Data

[63] Continuation-in-part of Ser. No. 943,904, Sep. 19, 1978, abandoned.

[51] Int. Cl.[3] ..... E04B 1/12; E04B 1/343

[52] U.S. Cl. ..... 52/233; 52/586; 52/309.4

[58] Field of Search ..... 52/233, 5 86, 316, 40, 52/285, 277, DIG. 8, 309.4

[56] References Cited

U.S. PATENT DOCUMENTS

| | | | |
|---|---|---|---|
| 1,655,701 | 1/1928 | Hyland et al. | 52/277 |
| 1,953,460 | 4/1934 | Bernhard | 52/233 |
| 1,971,994 | 8/1934 | Smith | 52/316 |
| 2,130,231 | 9/1938 | Forciea | 52/586 |
| 2,289,018 | 7/1942 | Jonsrud | 52/586 |
| 2,619,686 | 12/1952 | Dombrowski | 52/233 |
| 2,787,029 | 4/1957 | Johnson | 52/233 |
| 2,829,404 | 4/1958 | Wilson | 52/233 |
| 2,870,793 | 1/1959 | Bailey | 52/40 |
| 3,013,584 | 12/1961 | Reed et al. | 52/727 |
| 3,129,983 | 4/1964 | May et al. | 184/36 |
| 3,377,758 | 4/1968 | Witschnig | 52/285 |
| 3,970,401 | 7/1976 | Lubeck | 52/309.9 |
| 3,992,838 | 11/1976 | Vizziello | 52/404 |

*Primary Examiner*—James L. Ridgill, Jr.
*Attorney, Agent, or Firm*—Howard I. Podell

[57] ABSTRACT

A simulated log for construction and indoor or outdoor decorative use such as a divider panel or as a log beam comprised of at least two semi-circular imitation log siding sections comprising an outer covering with a simulated grain wood containing an insulated filler. An upright support has the central rear portion of the covering secured along its diameter. A pair of thicker uprights are secured to the first upright on the edge of log and have the outer ends of the covering secured thereto. The supports form an integral part of the log.

5 Claims, 6 Drawing Figures

INSULATING SIMULATED LOG AND SIDING

This application is a continuation-in-part of application 943,904 filed Sept. 19, 1978 now abandoned by the same inventors.

FIELD OF THE INVENTION

This invention relates generally to a simulated log and siding for construction.

DESCRIPTION OF THE PRIOR ART

The prior art, as exemplified by U.S. Pat. Nos. 1,655,701; 1,953,460; 2,619,686; 2,829,404; 3,377,758; 2,870,793; 3,129,983; 3,013,584; 3,970,401; 1,971,994; or 3,992,838 is generally illustrative of the pertinent art but the aforementioned patents are non-applicable to the present invention. While the prior art expedients are generally acceptable for their intended purpose only, they have not proven entirely satisfactory in that they are either complex and expensive to manufacture, or bulky and inconvenient to use. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a simulated log for construction and indoor or outdoor decorative use such as a divider panel or as a log beam preferably comprised of at least two semicircular imitation log siding sections comprising and outer covering with a simulated grain wood containing an insulated filler. An upright support has the central rear portion of the covering secured along its diameter. A pair of thicker uprights are secured to the first upright on the edge of log and have the outer ends of the covering secured thereto. The supports form an integral part of the log.

The generally implied use of the invention is a simulation of a round log or half log for siding constructed with a structural inner frame and outer curved surfaces of wood grain metal for exteriors and wood grain plastic laminates such as "formica" or fiberglass with a wood grain vinyl cover for interior surfaces. Into the shell thus built, insulation as required or wood chips with a binder, is placed or injected, the most efficient and the strongest of which would be urethane. The insulation "R" values would vary according to the type of insulation used and the log diameter with up to six times the "R" value of wood inch thickness.

The above brief description of the construction clearly indicates many varied and beautiful applications such as a super insulated log building with an outstanding selection of wood appearances outside and inside. As super insulated log siding on new buildings or for re-siding existing buildings, trailer homes, or portions thereof inside and outside; as exposed log beams both structural and decorative; many decorative applications by an imaginative designer. The "skin" for roofing would be a colored metal or vinyl.

The log conformation of these logs and log siding or roofing are a distinctive specialty for the customer with a desire for log appearance, ease of handling, the beauty of distinctive species of wood, and the ultimate in energy conservation with insulation.

The curved convex surfaces of a metal skin of log siding made up into panels as solar collectors would give constant orientation of more surface toward the sun giving greater efficiency without expensive tracking equipment, as compared with flat exterior panels.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENT

Figure 1:
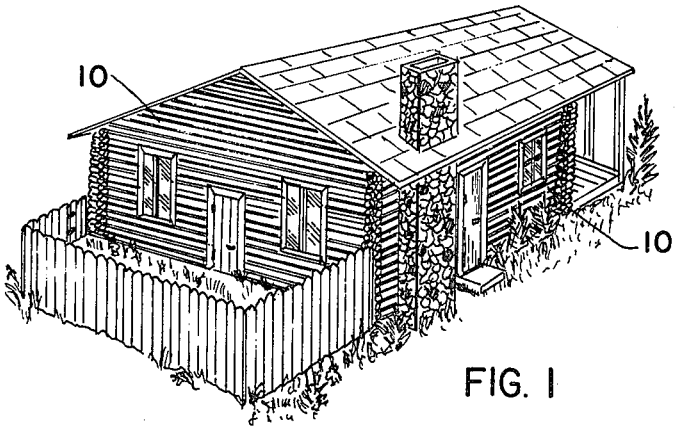
FIG. 1 is an isomeric view of a dwelling with walls composed of the simulated logs according to the concept of this invention.

With reference to the drawing, there is shown and illustrated a simulated log constructed in accordance with the principles of the invention and designated generally by reference character 10. The illustrated tangible embodiment of the invention includes an outer semi-cylindrical covering or skin 12 composed of wood grain, laminated plastic, fiberglas or embossed metal. Where fiberglas or plain metal are used, an additional outer skin or layer 11 of wood grain vinyl such can be glued or laminated to the exterior of skin 12.

The covering 12 is secured by adhesive at its opposed top and bottom ends to wood, metal or extruded plastic uprights 14, which extend the length of each log 10. As shown, the upper and lower sections of each log 10 are formed with a pair of recesses 21, 23 respectively, each of a rectangular shape and located to align with the similar recesses of another abutting log.

Figure 2:
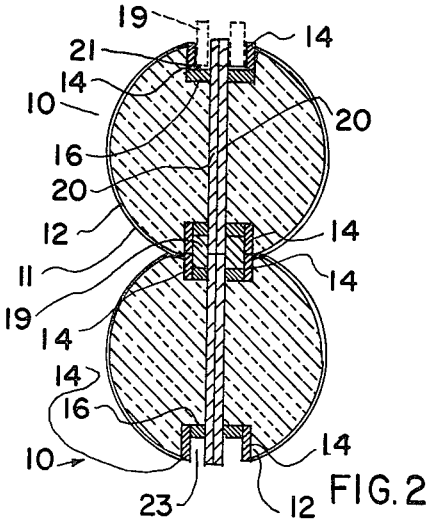
FIG. 2 is a cross-sectional view of a log assembly.

An assembly consisting of two round logs each formed of two units 10 is shown in FIG. 2. Each upright support 14 is fastened by a wood frame member 16 to a flat elongated central member 20 of plywood or metal sheet. Each flat member 20 is then fastened to the other by gluing or otherwise with supports 14, 16 and member 20 each bordering a recess 21 or 23, and with supports 14, 16 and member 20 extending the length of each log.

Insulating material 22 such as foamed polyurethane, urea formaldehyde or wood chips and sawdust-glue are injected into the hollow cores of the unit in known manner.

As shown in FIG. 2, two units 10 can be secured to each other in vertical array, by fitting a spline 19 of material such as a rectangular block of urethane plastic into the aligned upper and lower recesses 21, 23 respectively of a pair of abutting logs 10. Spline 19 may be glued in place or fastened by other means to the central members 20 of each log 10 to hold the vertical array in place.

The units 10 can be manufactured with a six to sixteen inch diameter and in lengths up to twenty feet.

Figure 3:
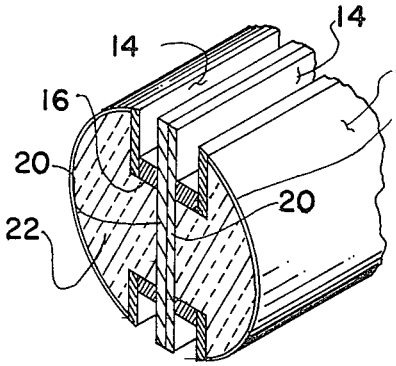
FIG. 3 is a detail perspective view of a log.

As shown in FIG. 3, transverse grooves 25 may be located near an end of each log 10 of a shape to fit a circular groove in another log 10 that extends transversely to the first log so as to form corner sections of a structure.

Figure 4:
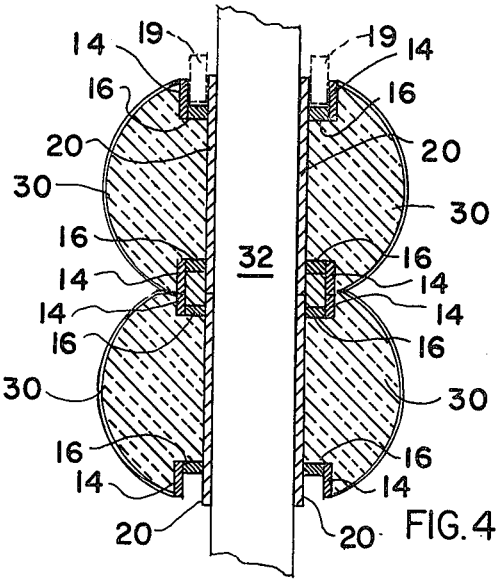
FIG. 4 is a sectional view of an alternative embodiment of two assembled half log sections.

FIG. 4 illustrates an alternative embodiment of log 10 in which two semi-cylindrical half-sections 30, each similar to one lateral half of a log 10 are each separately joined to opposed faces of a vertical wall stud 32 of a building structure. Additional such half-sections 30 may be stacked in vertical array with each half-section 30 joined to the vertical wall stud by fastening central member 20 to the stud 32, by adhesive or fasteners. Alternatively, half-sections 30 may be fastened to only one exterior side of vertical stud 32, with conventional flat panels fastened to the interior surface of the stud.

Figure 5:
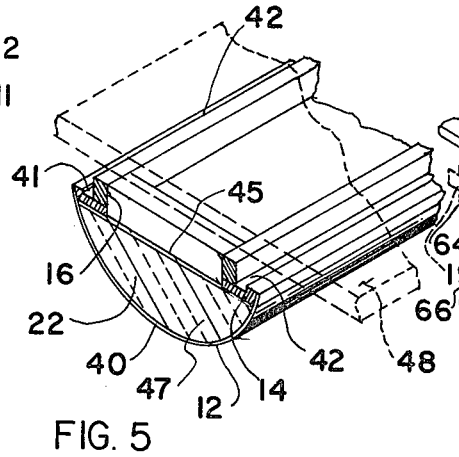
FIG. 5 is a perspective detail view of a further alternative embodiment of a half log section.

FIG. 5 illustrates an alternative embodiment 40 of a half log section that is suitable for directly mounting to an external face of a plywood sheathing 48 of a structure. Outer skin 12 is of a semi-cylindrical shape extending less than one-hundred-eighty degrees in a radial sector, and fastened at each longitudinal end to a support 14 which is fastened to a frame member 16 such as to form rectangular L-shaped recess 41, 42 at the upper and lower longitudinal edges. A sheet 45 encloses the interior chamber 47 which is filled with lightweight insulation material. Frame members 16 may be directly fastened to vertical sheathing of a building structure by nails, screws or adhesive, with splines 19 fitting into adjoining recesses 41, 42 of two adjoining half sections 40.

Figure 6:
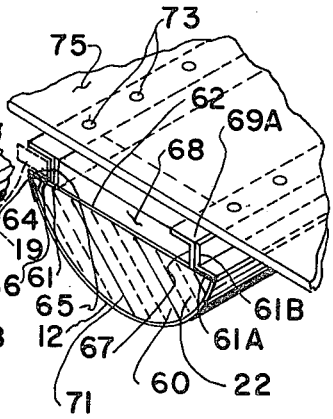
FIG. 6 is a perspective detail view of a still further alternative embodiment of a half log section.

FIG. 6 illustrates a further alternative embodiment of a half log section 60. A semi-cylindrical shaped outer skin 12 is joined, at opposed longitudinal ends to a leg 61 of a metal channel 62 or a leg 61A of a right-angle section 62A, by a flexible plastic hinge section 64, formed of two sections that are bent to converge together, with the skin glued to one such section 65 and the other section 66 glued to leg 61 or 61A.

Where an angle section 62A is employed, a second angle section 67 is welded to the other leg 61B of angle section 62A so as to form a section as shown or to form a channel section. A flat sheet 68 is joined to opposed angle sections to bound a hollow interior 71 which is filled with insulation material 22.

Each half log 70 may be joined to a flat wall panel 75 by fasteners extending through perforations 73 in leg 69 of channel section 62 or leg 69A of angle section 67, employing blind-type fasteners or alternatively fastening to wall panel 75 by adhesive.

Spline 19 fits into the recess formed by adjoining channels 62 of abutting log sections 70, or the recess formed by angle section 62A and panel 75 and may be glued in place.

As may be readily understood, a log section 10 may be formed by joining any two half log sections 30, 40, 60 back-to-back in the manner as shown in FIG. 2.

The invention may be fabricated as separate log sections, as separate half-log sections, or as siding formed of a plurality of log sections or half-log sections joined to a common central panel.

The use of the invention hereinabove described will be evident to those skilled in the art to which it relates from a consideration of the foregoing.

The present invention is believed to accomplish among others all of the objects and advantages herein set forth.

Without further analysis, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. An insulating simulated semi-log unit comprising an outer generally semi-cylindrical covering sheet integrally united along its length at opposed ends to a pair of upright supports, both of said supports joined to a flat panel section, with the interior of said unit, in which the upright supports are each spaced by joined spacer means from said flat panel section so as to form a lower and an upper open recess along the length of the unit at opposed ends of the unit, said recesses located such that when two such units are mounted in vertical array, with the flat panel section of one unit extending as a vertical extension of the panel section of the second unit, the lower recess of the upper unit is aligned with the upper recess of the lower unit so that a shaped spline unit may be fitted in said aligned units to latch the two sections together when said spline is fitted in said unit by fastening means.

2. The invention as recited in claim 1, in which two such units are mounted back-to-back to form a cylindrical shaped log unit by joining together of the exterior surfaces of the flat panel section of each semi-log unit.

3. The invention as recited in claim 1, together with a spline unit of the general length of a semi-log unit, said spline unit of a size and shape to snugly fit into the common interior of two aligned recesses of two semi-log units that are aligned in vertical array as recited in claim 1.

4. The combination as recited in claim 3, in which the spline unit is formed of a block of polyurethane foamed material.

5. The invention as recited in claim 1, in which a plurality of semi-log units are fastened in vertical array to a common panel to form a length of siding.

* * * * *